US006830162B2

(12) United States Patent
Guindulain Vidondo

(10) Patent No.: US 6,830,162 B2
(45) Date of Patent: Dec. 14, 2004

(54) SYSTEM FOR TRANSPORTING AND ELEVATING COINS IN PRIZE RECREATIONAL MACHINES

(75) Inventor: Félix Guindulain Vidondo, Peralta (ES)

(73) Assignee: Jofemar, S.A., Peralta (ES)

( * ) Notice: Subject to any disclaimer, the term of this patent is extended or adjusted under 35 U.S.C. 154(b) by 86 days.

(21) Appl. No.: 10/405,713

(22) Filed: Apr. 2, 2003

(65) Prior Publication Data

US 2003/0222097 A1 Dec. 4, 2003

(30) Foreign Application Priority Data

May 30, 2002 (ES) ..... 200201240

(51) Int. Cl.[7] ..... B66H 3/36
(52) U.S. Cl. ..... 221/253; 273/448
(58) Field of Search ..... 221/210, 155, 221/24, 7, 13, 192, 224, 253; 273/448

(56) References Cited

U.S. PATENT DOCUMENTS 4,685,673 A * 8/1987 Verstraeten ..... 273/448

* cited by examiner

*Primary Examiner*—Kenneth Noland
(74) *Attorney, Agent, or Firm*—Klauber & Jackson

(57) ABSTRACT

System for transporting and elevating coins in prize recreational machines, being of the type of prize recreational machine that functions by introducing coins and awarding cash prizes, in such a way that the system for transporting and elevating coins comprises a pair of continuous elastic transporter belts (4) and (5) guided by some cylindrical bodies, with at least one of the cylindrical bodies for guiding the pair of continuous transporter belts acting as a drive element due to the corresponding motor transmitting movement to it, in such a way that a first continuous elastic transporter belt (4) is mounted between a pair of cylindrical bodies (6) and (7) aligned in a vertical position, while the second continuous elastic transporter belt (5) is mounted between an upper cylindrical body (8) and a pair of lower cylindrical bodies (9) and (10).

4 Claims, 4 Drawing Sheets

SYSTEM FOR TRANSPORTING AND ELEVATING COINS IN PRIZE RECREATIONAL MACHINES

OBJECT OF THE INVENTION

As stated in the title of the present descriptive specification, the invention that follows refers to a system for transporting and elevating coins in prize recreational machines, being of the type of prize recreational machine that functions by means of introducing coins and awarding cash prizes, in such a way that the system that is presented has the purpose of transporting and elevating the coins corresponding to payments of prizes obtained to the collector or container for withdrawal by the user, the withdrawal collector or container being positioned at an ergonomic height in order to facilitate its accessibility.

The incorporation of a system for transporting and elevating coins in recreational machines likewise permits the incorporation of a compact unit in which are combined all the necessary mechanisms for manipulating the introduced coins, permitting the storage and return of a greater diversity of coins and also permitting a greater number of coins to be stored.

In this way, although the extraction of the coins contained in the corresponding stores for payment of prizes is done at a point very low down, as the coins are transported and elevated to the collector this enables the latter to be located in the position that is desired.

Moreover, as the extraction of the coins contained in the stores for payment of prizes does not have to depend on the position of the withdrawal collector, the tubular stores for the different types of coins can have a greater height, in other words, they can have a greater capacity, which represents an important advantage.

1. Field of Application

The system for transporting and elevating coins has application in those prize recreational machines which function by means of introducing coins, award cash prizes, and can present a great diversity of games.

2. Background of the Invention

Conventionally, prize recreational machines present an entrance mouth for coins at a suitable height in order to facilitate their introduction by the user, in such a way that the coins are in turn directed towards the validation selector by simple gravity, the mounting of the different components being conditioned both by the structure and by the actual functioning in itself of the machine.

So, on the one hand account has to be taken of the dimensions of the machine in order to facilitate its adaptability in numerous establishments, and on the other hand account has to be taken of the functioning dynamics of the machine, so that coins validated by the selector as being valid are directed by simple gravity to the final deposit coin-box or to the corresponding storage bin which in turn acts as a coin returner-counter.

In this way, in accordance with the structure of the machine, the arrangement of the different functioning components has to be combined, with special attention having to be paid to the positioning of those components on which the user acts, such as the mouth for introducing coins and banknotes and the withdrawal collector.

Also, recreational machines normally make their payments of prizes on the basis of two types of coin, for which the machine incorporates two storage bins, which in turn act as coin returners-counters, one for each type or value of coin to be returned, given that the incorporation of a greater number of bins presents problems if this is not to have an effect on the structure of the machine.

Moreover, the coins stored in the bins become totally disorganised, and their random capacity is determined by a simple overflow mechanism by which the coins are emptied into the final coin-box.

Furthermore, the coins contained in the bins are counted at the moment in which their unitary extraction is effected during payment of the prizes, which represents an inconvenience for carrying out proper control over the total number of coins introduced and payments effected.

DESCRIPTION OF THE INVENTION

This descriptive specification describes a system for transporting and elevating coins in prize recreational machines, being of the type of prize recreational machine that functions by means of introducing coins and awarding cash prizes, in such a way that the system for transporting and elevating coins comprises a pair of continuous elastic transporter belts guided by some cylindrical bodies, with at least one of the cylindrical bodies for guiding the pair of continuous transporter belts acting as a drive element, in such a way that a first continuous elastic transporter belt is mounted between a pair of cylindrical bodies aligned in a vertical position, while the second continuous elastic transporter belt is mounted between an upper cylindrical body and a pair of lower cylindrical bodies arranged in the upper and lower positions with respect to the pair of cylindrical mounting bodies of the first transporter belt, and vertically overlapped with respect to said pair of cylindrical mounting bodies of the first continuous transporter belt.

The second transporter belt, with respect to one of its branches, is backed onto one of the branches of the first continuous transporter belt, via whose cylindrical mounting bodies it is also guided, with some intermediate rollers collaborating in the guiding and backing of the pair of branches between which the coins are transported and elevated.

In a preferred embodiment of the invention, each continuous transporter belt will have at least one cylindrical mounting body for it as a drive element, in other words, movement will be transmitted to both transporter belts via the corresponding cylindrical mounting body, to which in turn the respective motor transmits rotary movement.

Moreover, the lower cylindrical mounting body of the first continuous transporter belt is arranged between the pair of lower cylindrical mounting bodies of the second transporter belt and according to an upper horizontal plane, with the lower cylindrical mounting body of the first continuous transporter belt acting as a guiding element of the second transporter belt, defining between them a small horizontal base on which the coins expelled from the deposit stores, obtained as payment of prizes, are directed, these coins being collected between the backed branches of the pair of transporter belts.

Also, the upper cylindrical mounting body of the first transporter belt is arranged according to a horizontal plane lower than the upper cylindrical mounting body of the second transporter belt, the upper cylindrical mounting body of the first continuous transporter belt acting as a guiding element of the second transporter belt, releasing the coins that are transported and elevated in a duct which empties to the collector for withdrawal of the coins by the user.

In this way, the expulsion of the coins from the different deposit stores for payment of prizes will be able to be effected at any point, so that they can be transported as far as the collector for withdrawal by the users, presenting the great advantage that the recreational machine can incorporate a compact unit comprising the coin selector, the separator for them, the deposit stores for the coins intended for payment of prizes, and the coin extractor.

Likewise, by being able to transport the coins awarded as payment for prizes that are won to the desired point, the collector for withdrawal of the coins by the users will be able to be located in the most suitable part of the machine, in other words, in the vicinity of the actual mouth for the introduction of coins.

So, the coin stores are defined by a series of tubular bodies, able to take a great diversity of coin types intended for payment of prizes, up to five, as well as having greater capacity.

Also, exact control can at all times be had over the coins introduced, the coins contained in the final coin-box, the coins contained in the different deposit stores and the coins expelled for payment of prizes; in other words, strict control is permitted, a control that can be carried out remotely.

In order to complement the description that is going to be made forthwith, and with the aim of aiding a better understanding of the characteristics of the invention, the present descriptive specification is accompanied by a set of plans, with figures representing the most characteristic details of the invention in a way that is to be regarded as illustrative rather than limiting.

DESCRIPTION OF A PREFERRED EMBODIMENT

Figure 1:
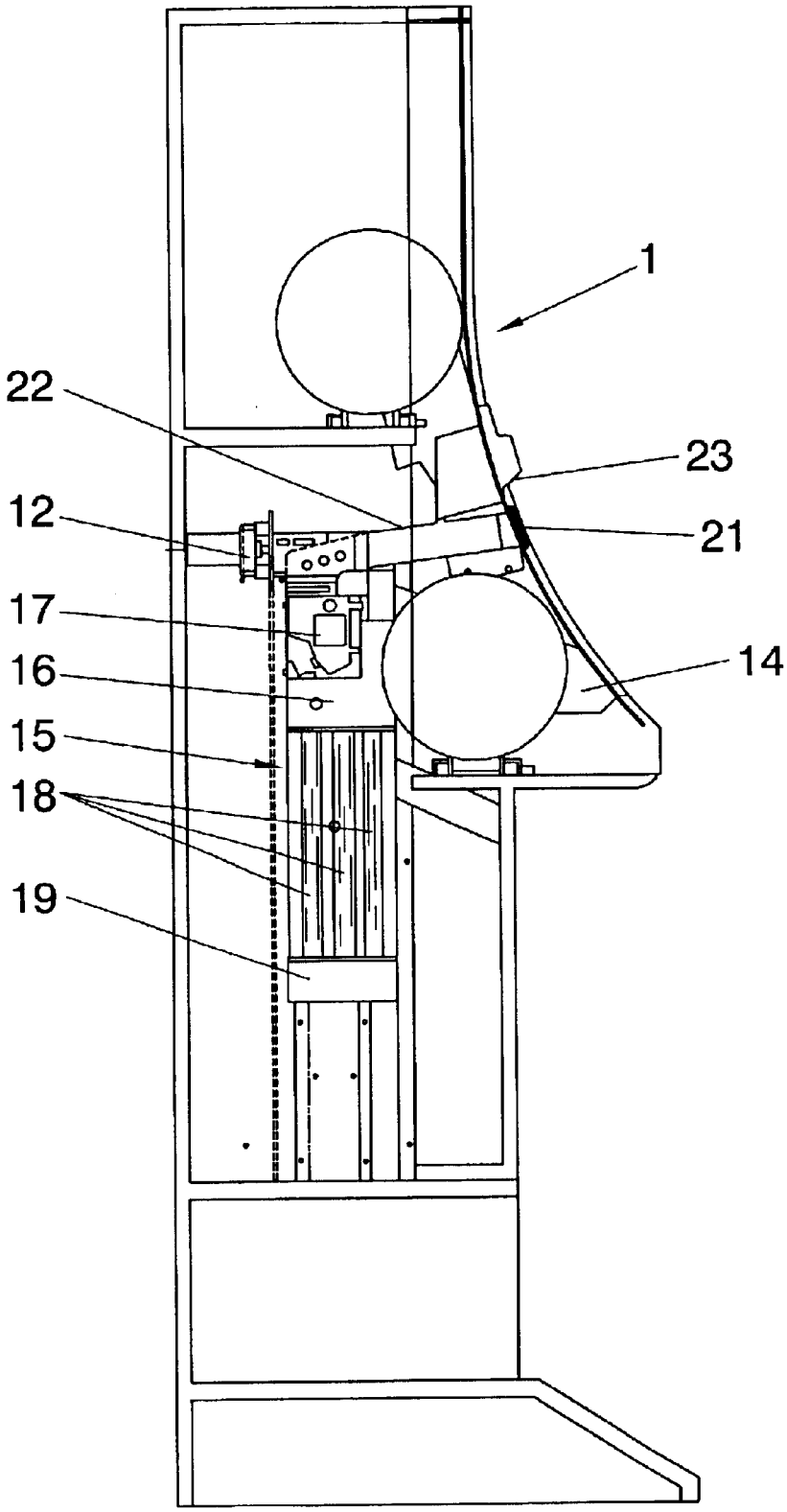
FIG. 1 shows a side raised view of a prize recreational machine, in which can be seen the unit in which are grouped the coin entrance mouth, the banknote entrance mouth and the coin withdrawal collector, along with the device for selection, distribution, storage and extraction of the coins.
Figure 2:
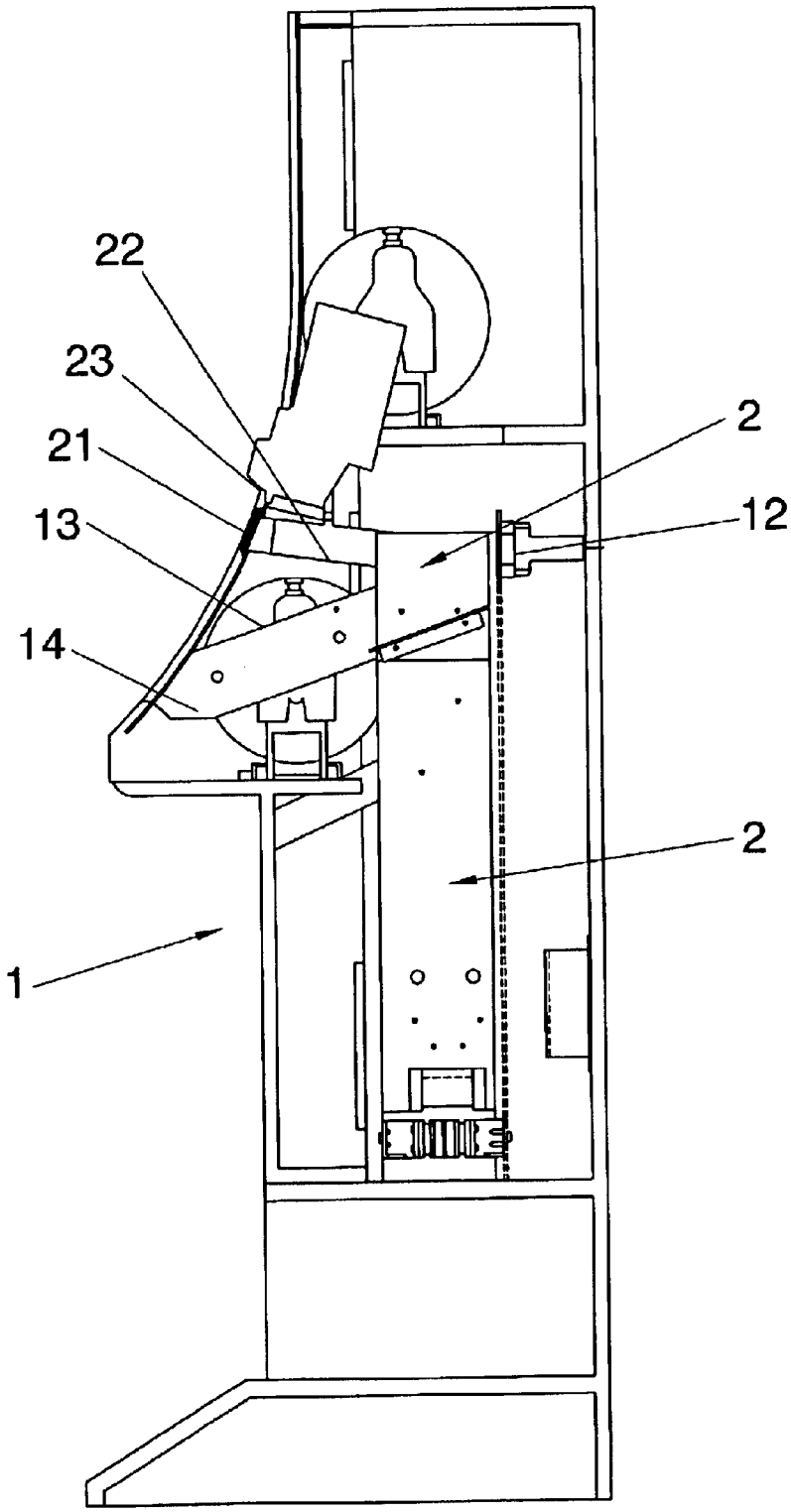
FIG. 2 shows a side raised view of the prize recreational machine, with a rotation of 180° with respect to the previous figure, in which can be seen the coin entrance mouth, the banknote entrance mouth and the coin withdrawal collector.
Figure 3:
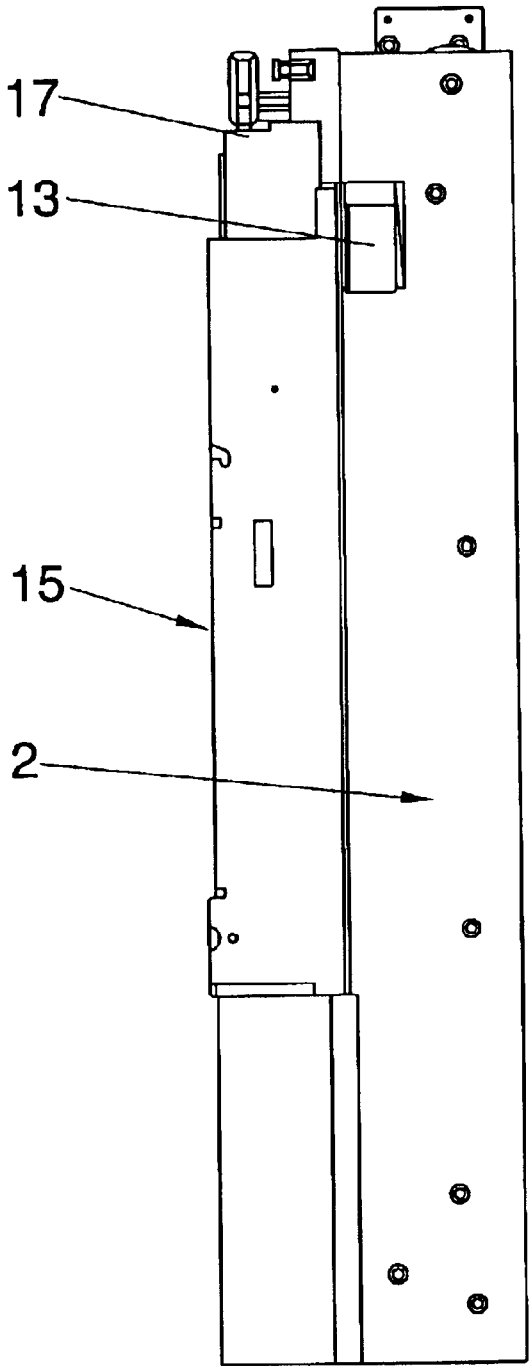
FIG. 3 shows a view of the unit grouping on the one hand the device for selection, distribution, storage and extraction of the coins, and on the other the unit that incorporates the system for transporting and elevating the coins in payment of prizes.

In view of the aforementioned figures and in accordance with the numbering adopted therein, we can see how the prize recreation machine 1, which functions by means of introducing coins and which awards cash prizes, presents a system 2 for transporting and elevating coins 3 for payment of prices, consisting of a pair of elastic continuous transporter belts 4 and 5 guided by some cylindrical bodies with at least one of the said cylindrical bodies for guiding the pair of continuous transporter belts acting as a drive element for transmitting movement to both transporter belts 4 and 5.

In this way, a first continuous transporter belt 4 is mounted between a pair of cylindrical bodies 6 and 7 aligned in the vertical position, while the second continuous elastic transporter belt 5 is mounted between an upper cylindrical body 8 and a pair of lower cylindrical bodies 9 and 10.

So, the upper cylindrical mounting body 8 of the second continuous transporter belt 5 is arranged according to a horizontal plane above the mounting plane of the cylindrical mounting belt 6 of the first elastic transporter belt 4, and vertically overlapped with respect to it, while the lower cylindrical mounting belt 7 of the first transporter belt 4 remains between the pair of cylindrical mounting bodies 9 and 10 of the second transporter belt 5, according to an upper horizontal plane.

As a consequence of this structure, the second transporter belt 5, with respect to one of its branches, is backed onto one of the branches of the first continuous transporter belt 4, via whose cylindrical mounting bodies 6 and 7 it is also guided, with some intermediate rollers 11 collaborating in the guiding and backing of the pair of branches, between which the coins are transported and elevated.

Movement can be transmitted to the pair of continuous elastic transporter belts 4 and 5, guided by the corresponding cylindrical bodies, by means of a cylindrical body for guiding one of the continuous transporter belts which will act as the drive element, such as might be the cylindrical body 8 for guiding of the transporter belt 5, to which body movement is transmitted by the corresponding motor 12, or each continuous transporter belt 4 and 5 can have a cylindrical body for guiding it by means of a drive element to which movement is transmitted by the corresponding motor.

Moreover, the lower cylindrical mounting body 7 of the first continuous transporter belt 4 is arranged between the pair of lower cylindrical mounting bodies 9 and 10 of the second transporter belt 5 and according to an upper horizontal plane, in such a way that the said lower cylindrical mounting body 7 of the first continuous belt 4 also acts as a guiding element of the second transporter belt 5, defining between them a small horizontal base on which the coins 3 expelled from the deposit stores, obtained as payment of prizes, are directed, these coins being collected between the backed branches of the pair of transporter belts 4 and 5 which are guided as a whole with respect to the cylindrical body 7.

The cylindrical bodies 9 and 10 are arranged according to different horizontal planes with the aim of adequately guiding the two transporter belts and leaving the cylindrical body 9 with its upper generatrix virtually flush with the lower generatrix of the cylindrical body 7, in order to perfectly gather the coins 3 awarded as prizes.

The upper cylindrical mounting body 6 of the first continuous transporter belt 4 is arranged according to a horizontal plane lower than the upper cylindrical mounting body 8 of the second transporter belt 5, the upper cylindrical mounting body 6 of the first continuous transporter belt 4 acting as a guiding element of the second transporter belt 5, releasing in relation to it the coins 3 that are transported and elevated in a duct 13 which empties into the collector 14 for withdrawal of the coins 3 by the user.

Figure 4:
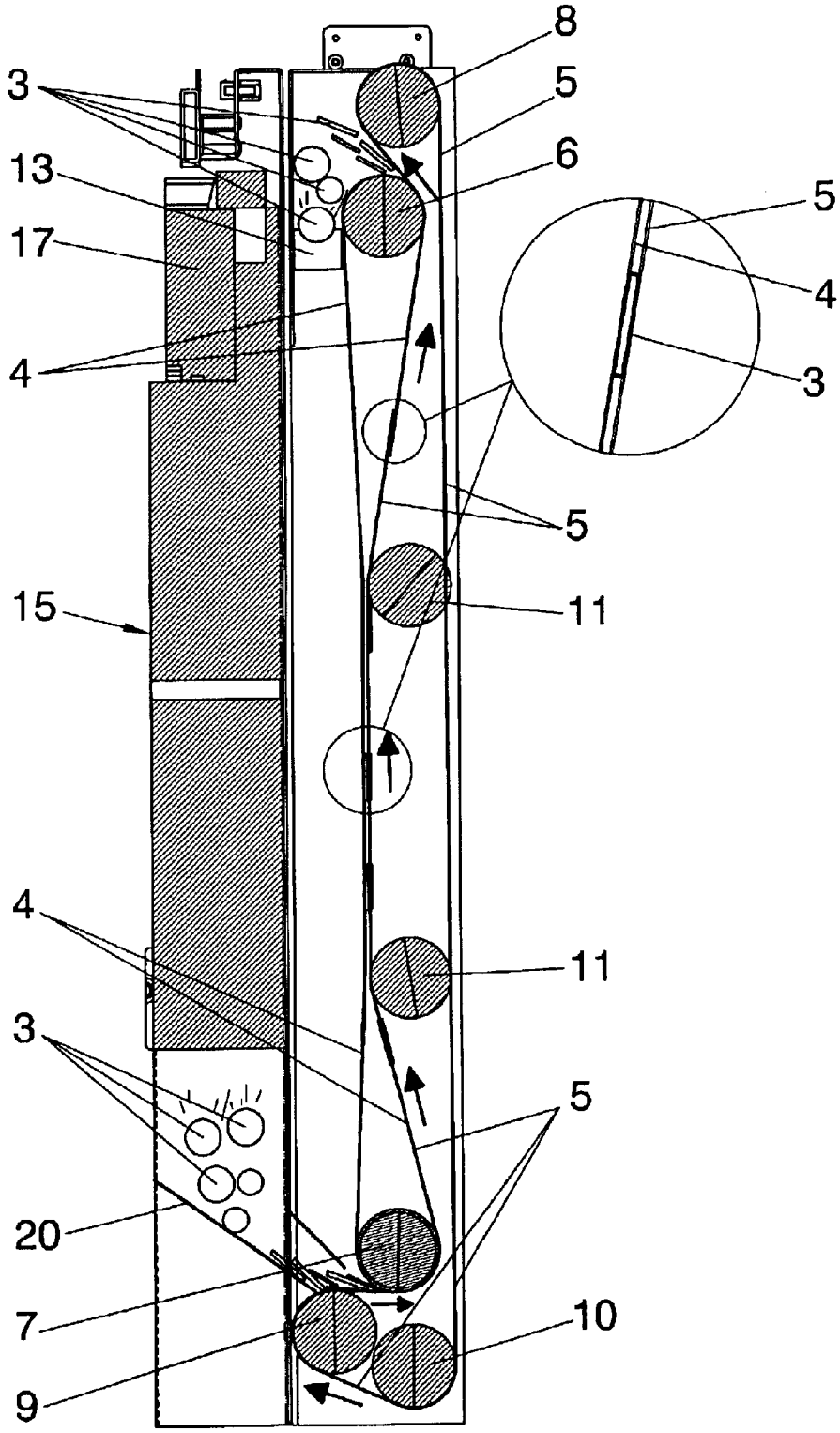
FIG. 4 shows a view of the unit grouping on the one hand the device for selection, distribution, storage and extraction of the coins, along with the system for transporting and elevating the coins in payment of prizes, in which it can be seen how the coins are directed by a pair of duly guided belts.

If we look at FIG. 4 of the designs, we see how the coins 3 are transported and elevated by the pair of transporter belts 4 and 5, in such a way that the elevation height will be able to be variable, permitting them to be transported as far as the desired point since they are arranged between the backed branches of those belts, as can be seen in the detail, when the transporter belt 5 is displaced in accordance with the direction of the arrows that are shown, dragging the transporter belt 4 along with it.

As the coins awarded as prizes can be elevated as far as the desired position, this permits the prize recreational machine 1 to incorporate a compact unit 15 containing a coin selector 17, a separator 16 for them, a series of stores for the coins to be awarded as prizes defined by some tubular bodies 18 and an extractor 19 by means of which the coins are extracted from the stores 18 in payment of the prizes and are directed along the duct 20 to the withdrawal point by the pair of elevator belts 4 and 5.

So, the user will introduce the coins via the mouth 21 in order to be directed via the duct 22 as far as the selector 17 contained in the compact unit 15, or he will introduce a banknote via the mouth of the "noteslot" 23 which will proceed to validate it, in such a way that if, during the course of the game, the user obtains any prize, the coins 3 for payment of that prize will be directed by means of the system for transporting and elevating them as far as the collector 14 for withdrawal by the user.

With this structuring, the collector 14 for withdrawal of the coins by the user can be provided in the most suitable place of the recreational machine 1 in order to facilitate the said withdrawal operation.

In other words, as the expulsion height or point for the coins 3 of the corresponding deposit stores 18 does not depend on the position of the collector 14, so both one and the other will be able to be placed in the position that is desired.

Also, the deposit stores 18 for the coins intended for payment of prizes can thereby have a greater height, in other words, they can have a greater capacity, and collaborating in this is the fact that the compact unit 15 can be incorporated provided with various tubular stores, such as five for example, permitting a greater diversity to be had in the types of coins to return.

Similarly, given that the compact unit 15 also incorporates the corresponding control electronics, this permits it to be known at all times, even remotely, all the data relating to the machine such as: number and type of coins introduced, number of coins contained in the different deposit stores, or the prizes awarded, thus permitting exact control over all the operations performed.

What is claimed is:

1. System for transporting and elevating coins in prize recreational machines, being of the type of prize recreational machine that functions by means of introducing coins and awarding cash prizes, wherein the system for transporting and elevating coins comprises a pair of continuous elastic transporter belts guided by some cylindrical bodies, with at least one of the cylindrical bodies for guiding the pair of continuous transporter belts acting as a drive element due to the corresponding motor transmitting movement to it, in such a way that a first continuous elastic transporter belt is mounted between a pair of cylindrical bodies aligned in a vertical position, while the second continuous elastic transporter belt is mounted between an upper cylindrical body and a pair of lower cylindrical bodies arranged in the upper and lower positions with respect to the pair of cylindrical mounting bodies of the first transporter belt, and vertically overlapped with respect to said pair of cylindrical mounting bodies of the first continuous transporter belt, in such a way that the second transporter belt, with respect to one of its branches, is backed onto one of the branches of the first continuous transporter belt, via whose cylindrical mounting bodies it is also guided, with some intermediate rollers collaborating in the guiding and backing of the pair of branches between which the coins are transported and elevated.

2. System for transporting and elevating coins in prize recreational machines, according to claim 1, wherein each continuous transporter belt has at least one cylindrical body for guiding said belt as a drive element, to which movement is transmitted by a corresponding motor.

3. System for transporting and elevating coins in prize recreational machines, according to claim 1, wherein the lower cylindrical mounting body of the first continuous transporter belt is arranged between the pair of lower cylindrical mounting bodies of the second transporter belt and according to an upper horizontal plane, with the lower cylindrical mounting body of the first continuous transporter belt acting as a guiding element of the second transporter belt, defining between them a small horizontal base on which the coins expelled from the deposit stores, obtained as payment of prizes, are directed, said coins being collected between the backed branches of the pair of transporter belts.

4. System for transporting and elevating coins in prize recreational machines, according to claim 1, wherein the upper cylindrical mounting body of the first transporter belt is arranged according to a horizontal plane lower than the upper cylindrical mounting body of the second transporter belt, the upper cylindrical mounting body of the first continuous transporter belt acting as a guiding element of the second transporter belt, releasing the coins that are transported and elevated in a duct which empties into the collector for withdrawal of the coins by a user.

* * * * *